US005806624A

United States Patent [19]

Nordtvedt

[11] Patent Number: 5,806,624

[45] Date of Patent: Sep. 15, 1998

[54] ESCAPE SYSTEM

[76] Inventor: Svein Nordtvedt, Blomvikvn. 27, Breivik, N-5074 Godvik, Norway

[21] Appl. No.: 211,143

[22] PCT Filed: Sep. 30, 1992

[86] PCT No.: PCT/NO92/00163

§ 371 Date: Mar. 22, 1994

§ 102(e) Date: Mar. 22, 1994

[87] PCT Pub. No.: WO93/06889

PCT Pub. Date: Apr. 15, 1993

[30] Foreign Application Priority Data

Sep. 30, 1991 [NO] Norway ..... 913822

[51] Int. Cl.[6] ..... A62B 1/20

[52] U.S. Cl. ..... 182/48

[58] Field of Search ..... 182/48, 49; 193/25 R

[56] References Cited

U.S. PATENT DOCUMENTS

| | | | |
|---|---|---|---|
| 99,399 | 2/1870 | Burditt | 193/25 R |
| 275,083 | 4/1883 | Schuett | 193/25 R |
| 482,274 | 9/1892 | Pride | 193/25 R |
| 797,012 | 8/1905 | McPheeters | 193/25 R |
| 3,435,492 | 4/1969 | Banas | 193/25 R |
| 4,167,224 | 9/1979 | Kinase et al. | 182/48 |

*Primary Examiner*—Alvin C. Chin-Shue

*Attorney, Agent, or Firm*—McAulay Fisher Nissen Goldberg & Kiel, LLP

[57] ABSTRACT

The escape system comprises a series of wall openings along a building wall and a stocking of mesh cloth material extending along the wall. The stocking has a series of access openings to the interior of the stocking and a series of annular bracing rings for bracing the stocking. Each bracing ring is braced against the building wall by a bridge-like connection between an access opening in the stocking and an associated opening in the building wall.

11 Claims, 2 Drawing Sheets

ESCAPE SYSTEM

This invention relates to an escape system. More particularly, this invention relates to a stocking-type escape device employed on the outside of a building.

As is known, various types of escape devices of stocking-type have been known, for example as described in U.S. Pat. No. 4,595,074. In such escape devices, the escape device has been constructed of tubular form with annular reinforcing elements at vertically spaced apart points. In addition, pieces of netting are disposed along the length of and within the escape device in an oblique manner so as to form sideways for a user.

Still other types of escape devices have been described in U.S. Pat. Nos. 4,162,717 and 3,977,495 which are of chute form which can be hanged by and from hardware outside a building. British Patent 1,378,561 describes a similar structure.

The escape system of the present invention comprises a series of wall openings along a house wall and a stocking extending axially along the house wall, which is of cloth material, preferably net-formed or meshed cloth material, and which is extendable from an inactive, axially compacted position, to an active use position extended axially in the height direction in a path along the wall openings in the house wall where the stocking is provided with a corresponding series of access openings to the interior of the stocking, and where each access opening is arranged in an intermediate space between a pair of mutually separated bracing rings, which are designed for bracing the stocking at corresponding height levels in the stocking, while guide means, which are arranged in a path internally in the stocking, extend separately from bracing ring to bracing ring and at the access opening form a partition between an external passage via the access opening and an internal passage in the stocking along the guide means.

Generally the invention relates to a flight system where there is employed a stocking-like escape device hanging substantially vertically downwards along a building wall. The escape device permits the flight of persons outside the normal escape routes of the building and allows the passage of persons inwardly into and outwardly from the escape device, at opposite ends of the escape device (upper and lower end) as well as in positions between the ends. The escape device is more especially of the kind which is illustrated in U.S. Pat No. De. 149,760 and is particularly designed for use in connection with multi-storied buildings, such as hotels, business buildings, housing complexes, etc. However the invention can also be readily adapted for other applications, for example for use on board passenger ships or on board sea-based (off shore) dwelling rigs and for similar purposes. As regards particularly high buildings it is known, in connection with rescue stockings according to U.S. Pat. No. De. 149,750, to employ materials and constructions, which with respect to tensile strength and elastic deformations, do not place any practical limitation on the stretched length of the stocking in connection with evacuating high houses. Nevertheless it can be appropriate for practical reasons to employ two or more mutually separated, but functionally and constructionally cooperating escape devices, which can span over their respective height-wise following floors, with the possibility of access from escape device to escape device, if necessary via suitable transfer arrangements between these.

In a condition ready for use the escape device is extended in a state hanging vertically downwards from an upper fastening to a lower fastening on the outer side of the building. With particularly high buildings where two or more escape devices are employed height-wise one after the other, the separate escape devices can for example be arranged vertically aligned or laterally displaced relative to each other.

In order to ensure an accurate path of the stocking along the wall of the building, with a correct orientation of the access openings relative to the wall openings in the wall of the building, the escape device is provided with special longitudinal control means, such as hoisting lines, guide rails and control lines, which are anchored or which can be anchored to specific fastenings at the upper and lower end of the stocking.

With the use of the escape device in connection with multi-storied buildings a need has arisen for extra anchorings of the device in locations between its upper and lower ends, so that unintended movements of the stocking can be reduced along and/or towards and from the wall of the building, partly as a result of weather and wind stresses and partly as a result of persons' use of the escape device. Especially when several persons are under simultaneous passage downwardly through the stocking and when in addition strong winds or powerful wind gusts predominate, the stocking can easily be exposed to uncontrolled movements relative to the wall. Such movements can produce difficult or dangerous conditions during the transfer of persons to or from the stocking from or to the wall openings.

According to the invention the aim is to anchor the stocking with special fastening means fastened locally to specific fastening points in or at the house wall and locally to the stocking at an associated bracing ring in the stocking, so that the stocking can be anchored in a relatively precise manner in connection with adjacent wall openings on the wall of the building.

According to the invention a further aim is to ensure a best possible secure and, for persons who use the device as far as possible, safe connection between the access opening of the stocking and the equivalent wall opening of the building, so that the escape via the device can take place in a controlled and safe manner. In particular, the aim is to be able to create safety and security for the persons who are to be transferred at relatively great heights between access opening and wall opening or vice-versa.

The escape device employs a rigid connecting means which is adapted to form a bracing means between a bracing ring in the stocking and a fastening in the house wall and form a rigid bridge connection between an access opening in the stocking and an associated wall opening in the house wall. The connecting means, forms a connection at one end with the stocking via a respective bracing ring at an associated access opening, and, with the other end forms a connection with the house wall just by an associated wall opening. A first anchoring means which is in permanent union with the connecting means at one end of the connecting means, is adapted to be locked in combination with a second anchoring means, which is connected to the stocking or the house wall, and correspondingly at the other end, the connecting means is directly connected to the house wall or the stocking.

The connecting means ensures an effectively braced anchoring of the stocking to the house wall at suitable levels along the wall. In addition, with the respective connecting means an effectively braced bridge connection can be ensured between the wall opening in the house wall and the access opening in the stocking, so that a safely braced and secure escape passage can be obtained for persons who are to pass between the wall opening in the house wall and the access opening in the stocking.

In practice, the connecting means can be permanently connected in rigid union with an associated bracing ring in the stocking, while a stationary anchoring means is employed in the house wall for anchoring the connecting means to the same. By this, there is the possibility, on setting out the rescue stocking, of allowing the connecting means to form spacing means relative to the house wall, even without the locking connection between the associated anchoring means.

In addition, one ensures that the connecting means can be adjusted into the intended position directly above the stationarily arranged anchoring means in the house wall immediately the stocking is set out from a folded condition to an extended condition along the house wall. Consequently, the anchoring means of the connecting means and the anchoring means in the house wall can thereby be relatively easily combined in locking engagement with each other immediately the stocking is set out along the house wall.

By such a solution, an effective bracing in and at the access opening in the stocking can also be ensured by means of the rigid connecting means and the bracing ring rigidly connected with that.

Alternatively, the connecting means can be allowed to be permanently connected to the house wall, while a stationary anchoring means is employed in combination with the stocking. Also, in such a case there can be ensured an effective bracing of the stocking relative to the house wall and an effective bracing of the connecting means in combination with the bracing ring in the stocking.

It is preferred that the anchoring means are pivotably mounted about a horizontal axis relative to each other.

By this, there is the possibility for the connecting means on suitable swinging about to be able to compensate for certain height deviations between the fastening at the wall opening in the house wall and the fastening at the access opening in the stocking.

More especially with respect to the protection of persons who are to be transferred in the passage between the wall opening and the access opening in the stocking, it is advantageous that the connecting means is provided with a lock-forming passage between the wall opening and the stocking opening, comprising shields on opposite sides of the passage between the building and the stocking.

Further features of the invention will be evident from the following description having regard to the accompanying drawings, in which.

Figure 1:
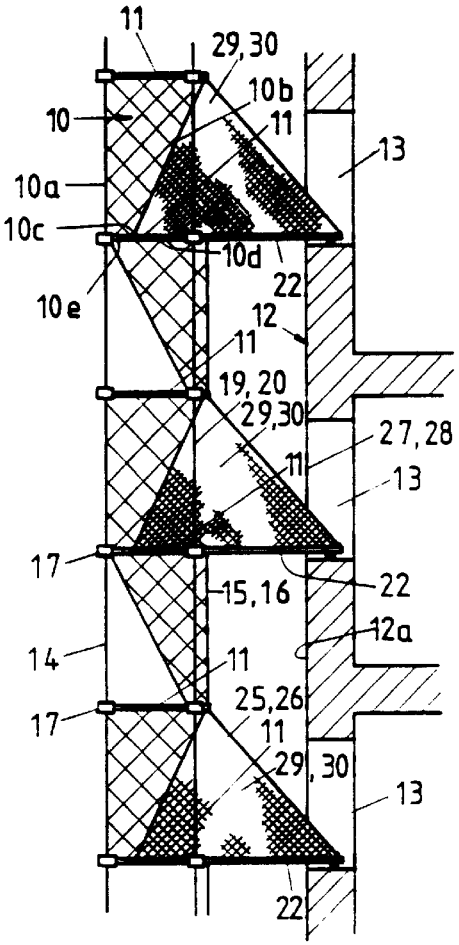
FIG. 1 shows the escape system according to the invention, with an escape device according to a first embodiment, illustrated in vertical section.
Figure 2:
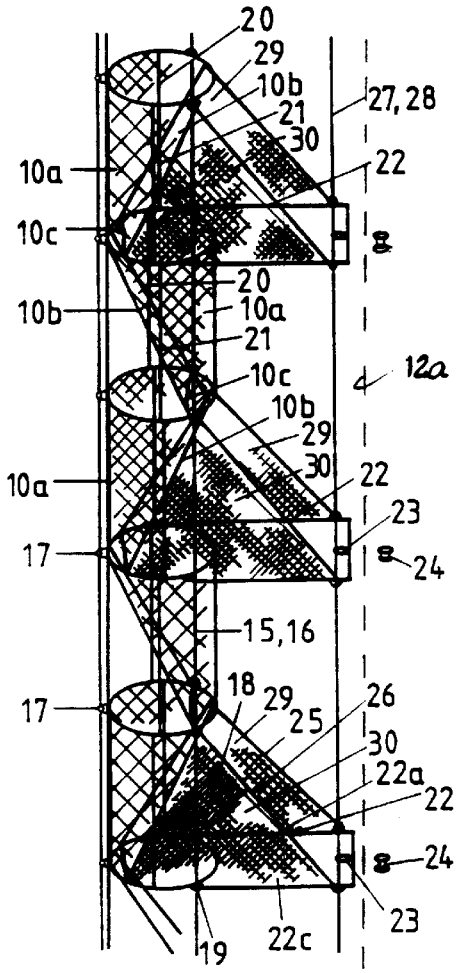
FIG. 2 shows the escape device according to FIG. 1 illustrated in perspective.
Figure 3A:
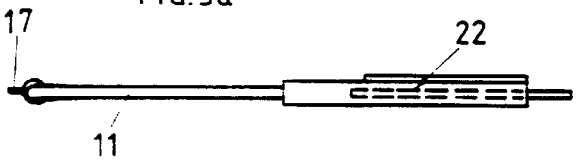
Figure 3B:
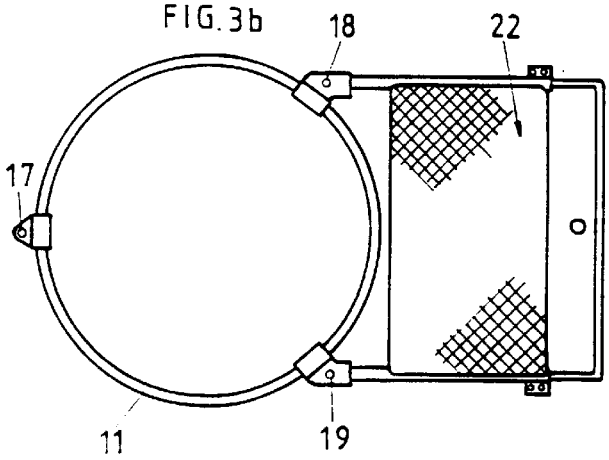

FIG. 3*a* and 3*b* show respectively a side view and a plan view of an entry board for use in the escape device according to FIG. 1 and 2.

Figure 4:
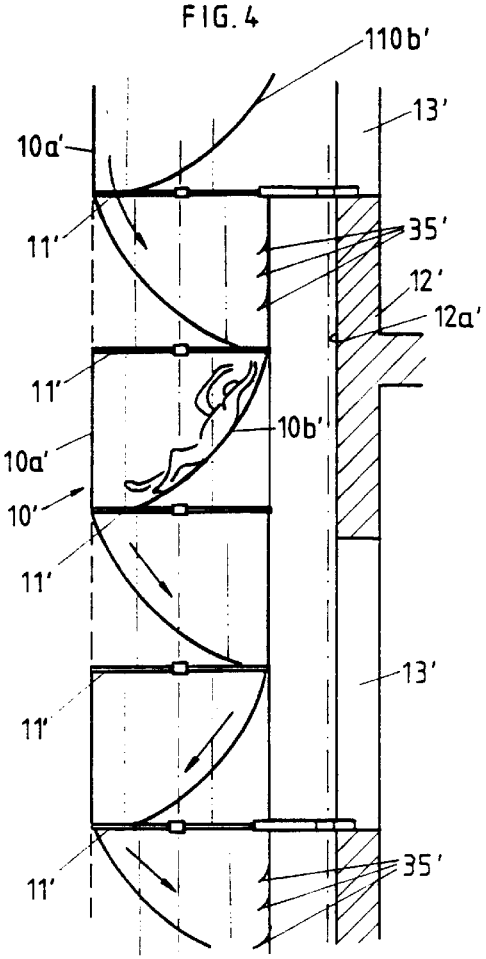

FIG. 4 shows an escape device in a second embodiment according to the invention, illustrated in vertical section.

Figure 5:
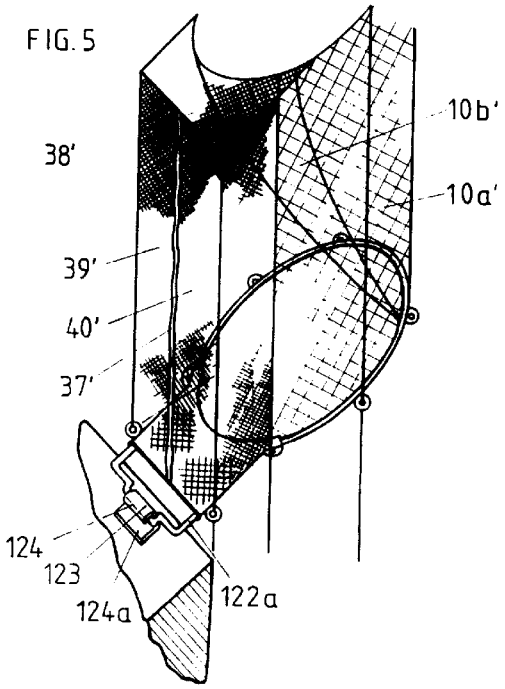

FIG. 5 shows the escape device according to FIG. 4 illustrated in perspective.

Figure 6:
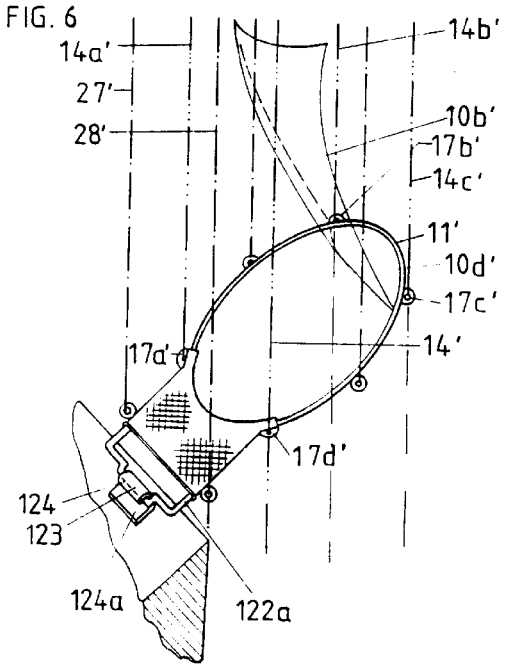

FIG. 6 shows a perspective view of an entry board for use in the escape device according to FIG. 4 and 5.

Referring to FIGS. 1 and 2, the escape system comprises a building and an escape device according to a first embodiment. The escape device comprises a stocking 10 of cloth material, that is to say in the illustrated embodiment in the form of a net-formed or meshed material, so-called fish net material. It is preferred to employ cloth material or fish net material made of Kevlar-fiber, so that a heat-durable, light-weight, shape-stable and stretch-firm material of high E-modulus can be obtained. The preferred material is nevertheless readily flexible by virtue of the fibre structure, so that it is alternately easily folded together and easily stretched out to a relatively shape-stable wall-forming form. Various types of material can be employed in different regions of the stocking, all according to the objective. Generally, the aim is to use fire-retarding materials. In any event, certain parts and preferably the major portion of the stocking ought to be made of material able to be blown through (meshed) in order to prevent collections of smoke in the stocking and in order to ensure the least possible wind-catching space in the stocking. Other parts of the stocking can be made of tight or tighter cloth material in order to form heat shields, wind shielding, slide paths and the like in local parts of the stocking.

The stocking 10 is provided at specific vertical levels, for example mutually spaced at 1.5 meters as shown in FIG. 1 and 2, with a bracing ring 11 for stretching of the stocking to a desired passage cross-section. Consequently, the stocking 10, reckoned relative to an adjacent building 12, can be provided, over each floor height, which for example has a dimension of 3 meters, with three bracing rings, such as illustrated at 11*a*, 11*b*, 11*c* uppermost in FIG. 1. With floor heights less than 3 meters the mutual spacing between the bracing rings can be equivalent to less than 1.5 meters and with floor heights greater than 3 meters equivalent to greater than 1.5 meters. In other words, provision is made for the axial length of the stocking 10 to correspond to the vertical height of the building between the upper and lower end of the stocking or to constitute a multiple of said height. The distance between each third bracing ring in the stocking constitutes a distance corresponding to the distance between two wall openings 13 in the adjacent building 12. In order to ensure a stable vertical spacing between the bracing rings adapted to each floor from the uppermost to the lowermost in a rescue stocking stretched out along a wall of a high rise building, each bracing ring 11 can be advantageously connected to two or more vertically extending, strong Kevlar-ropes which take up the major portion of the tensile load of the stocking. In order not to impair the through supporting ability of the Kevlar-ropes at each fastening to the bracing rings, each fastening point can advantageously employ a force-transferring fastening means in the form of a stocking braided about the Kevlar rope. The stocking-formed fastening means can form for example a sling around the bracing ring, as correspondingly described in U.S. Pat. No. De. 169,555. The Kevlar-rope can also be protected in a manner known per se against UV-irradiation by means of a light, reflecting and heat-durable casing of a suitable cloth material.

A favourable stocking diameter is of 1.2–1.5 meters, something which gives a reasonably good possibility of movement and at the same time a controlled guidance for a person descending in the stocking. Correspondingly, a favourable distance between each pair of bracing rings 11 is 1.5 meters, there being obtained at the illustrated fastening of the slide paths an angle on the slide paths internally in the stocking which is favourable in practice and simultaneously a favourable slide length within each stocking section. By this, a moderate descending speed can be achieved with the possibility for controlled sliding from bracing ring to bracing ring.

In practice however, the slide paths can be arranged in a manner other than shown in FIG. 1 and 2, for example by terminating the slide path in an extra bracing ring (not shown) arranged at a distance of 1 meter from its upper bracing ring. In such a case an extra, bag-forming stocking section can be arranged for example between an upper and a subsequent lower funnel-shaped stocking section. In the bag-forming stocking section, there can be employed a constricted passage opening centrally in the lower end of the bag-forming section. As desired, more or fewer bracing rings can be employed than shown in the drawings. Alternatively, instead of fastening the slide path between two bracing rings one end of the slide path can be fastened to the stocking material itself spaced from the bracing ring.

In the illustrated embodiment, the bracing rings 11 are fastened on the outer side of the stocking, but in alternative constructions can be fastened on the inner side of the stocking or received in a stocking pocket (not shown further in the drawing) between the inner side and the outer side of the stocking. There are illustrated three separate hoisting lines 14, 15, 16, which are distributed having 120 degrees intermediate space relative to the bracing rings and which are threaded through three corresponding vertically extending guides 17, 18, 19 on the associated bracing ring. The hoisting lines 14–16 which can be employed for hoisting and lowering down of the stocking relative to an upper (not shown) fastening, are fastened to a lowermost bracing ring or another (not shown) bottom portion of the stocking and form control lines for axially following bracing rings of the stocking. The hoisting lines 14–16 can for example, be operated by a common three-drum hoisting winch which is arranged in or on an upper housing (not shown further), in which the stocking with accessories can be stored in a hoisted, folded condition. The housing can be designed in an arbitrary manner and can for example also form accommodation and change space for one or more persons who are to be transferred to the stocking of the escape device in the lowered use condition.

The hoisting lines can for example be formed of steel wire, which below the lower bracing ring after unfolding of the stocking along the house wall, can be connected to a permanent lower fastening point a suitable distance from the house wall. After this, the hoisting line can be held tightly mounted, for example by means of a hoisting winch, in a desired position along the house wall.

Advantageously, the hoisting winch can be equipped with a centrifugal brake, which ensures lowering of the stocking at a controlled speed, without a need for electric current or other energy supply. Generally speaking the hoisting winch does not need to be equipped with a motor, the hoisting lines if necessary being able to be wound in again by means of a hand crank. In an extreme condition, the hoisting lines, the hoisting drum and the winch can be completely discarded, since the stocking by virtue of its low weight and great strength can be let go in free fall along the house wall from its upper position, where the stocking is stored in a folded condition. The lower bracing ring or a grommet on the longitudinal Kevlar-ropes can in that case be advantageously connected in taut connection to a lower fastening point after the stocking is finally outstretched.

In the illustrated embodiment, the stocking 10 between each pair of bracing rings 11 is constructed with a stocking section of a part-cylindrical back portion 10*a* and an obliquely extending, part-conical surface fashioned front portion 10*b*. The back portion 10*a* surrounds an upper bracing ring 11 over an arc of approximately 360 degrees and a lower bracing ring 11 over an arc of approximately 60 degrees. Correspondingly the front portion 10*b* surrounds the upper bracing ring 11 over an arc of approximately 60 degrees and engages below with the lower bracing ring at two fastening points with a mutual spacing of approximately 60 degrees and besides extending across the bracing ring fastened to a somewhat elastically yielding fastening strap 10*c*. Consequently, the stocking section extends with a funnel-shaped passage from an upper bracing ring to a lower bracing ring. A series of such stocking sections is shown arranged one after the other in a vertical direction.

Internally in the stocking, the front portion 10*b* forms a slide-forming path between the upper and the lower ring, while externally the front portion 10*b* forms a stocking outer surface extending obliquely downwards and inwards. The front portion 10*b*, which is fashioned in an upper stocking section, uncovers an upwardly and outwardly opening access opening 10*d* to the stocking section following below, while in the upper stocking section between the back portion 10*a* and the front portion 10*b* there is uncovered an internal passage opening 10*e* to the stocking section following below on a level with the access opening 10*d*. By means of the upwardly opening, access openings the possibility of local ventilation is obtained in each stocking section in order to prevent the collection of smoke in the escape device. In special constructions the access openings, which are not employed for climbing in or climbing out, can be covered up with suitable meshed material in a manner not shown further.

The subsequent stocking section(s) is/are fashioned correspondingly, but mutually turned 180 degrees relative to the stocking section which lies above. This involves forming a continuous, zig-zag shaped passage through the stocking from stocking section to stocking section, at the same time as an upwardly and outwardly opening 10*d* is formed at the upper end of each stocking section over the whole height dimension of the stocking.

Provision is made for the stocking 10 to be suspended with the one set of access openings facing directly towards an equivalent wall opening 13 in the adjacent building 12. The remaining access openings on the other hand face away from the building 12 and can if necessary be used for communication with other escape devices (not shown further). A connecting means 22 is fastened to a bracing ring 11 at each wall opening 13 and projects laterally outwards from and horizontally flush with the associated bracing ring 11 at certain of the access openings, that is to say in the illustrated embodiment only at the access openings which face towards the adjacent building. For practical reasons, provision is made for the thickness of the connecting means not to exceed double the thickness of the associated bracing ring, in order to obtain thereby the least possible building height for the stocking with rings and connecting means in the inactive folded condition of the stocking. At the outer end the connecting means 22 is equipped with a locking means 23 which is adapted to cooperate with an equivalent locking means 24 fastened to the building at the lower portion of the wall opening 13. The locking means 23 on the connecting means 22 is shown in the form of a vertically disposed bush which is adapted to be threaded into a snap engagement with an equivalent pin-shaped locking means 24 on the building 12. In other words, the locking means 23 forms a part of one piece with the connecting means 22.

The connecting means 22 is shown in FIG. 2 in the form of a rigid loop 22*a* having an intermediate rigid plate 22*c* which is terminated just by the adjacent ring portion of the bracing ring 11. In practice, the connecting means forms a rigid, non-inflammable and relatively robust, bridge-forming path portion between the access opening 10*d* in the stocking 10 and the wall opening 13 in the building 12.

The connecting means 22, which is rigidly connected to a first (lower) bracing ring in an upper stocking section, is connected at its outer corners via obliquely extending, guy-forming support lines 25,26 to a second (upper) bracing ring in the upper stocking section. Through the series of connecting means 22 pass in addition a pair of vertically extending hoisting lines or stabilising lines 27,28. The stabilising lines 27,28 can be hoisted and lowered synchronously with the hoisting lines 14–16 by means of a separate hoisting winch. If necessary, the lines 27,28 can replace the hoisting lines 15,16 and the lines 14,27,28 can then be operated with a common three drum hoisting winch. In practice, the stabilising lines 27,28 in a condition ready for use can form, if necessary the a lateral support against the adjacent wall 12*a* of the building 12.

In FIG. 1 and 2, a pair of screen-forming guide means 29, 30 are shown, which are of cloth-formed material and which are fastened below to the connecting means 22 and which in front/above are fastened to the obliquely extending lines 25,26 and which in the rear are fastened to the stocking section in the seam between its back portion 10*a* and front portion 10*b*. The screenforming guide means can in a manner corresponding to the adjacent stocking section be made of meshed material, but can if desired be made of relatively tight, especially shielding cloth material, so that a typical lock-fashioned, flame shield-forming passage is formed from the wall opening in the building 12 to the access opening in the stocking 10. When a person passes the lock-formed passage (for example with the legs first) it is possible for the person to ensure an effective hand grip on the obliquely extending lines 25,26.

In FIG. 3*a* and 3*b* there is shown a somewhat modified construction of a connecting means 22', where a loop 22*a*′ with associated plate 22*b*′, is axially regulatably, that is to say telescopically displaceably, received in an equivalent horizontal guide (not shown further) in a rigid support member 22*c*′ which is fastened with lugs 22*d*′ to an associated bracing ring 11. The loop 22*a*′ with associated plate 22*b*′ having an associated bush-formed locking means 23 consequently constitutes a separate fastening means which is axially regulatably fastened to the support member 22*c*′. By means of a snap-forming stop means (not shown further in the drawing) on the support member, the fastening means 22*a*′, 22*b*′ can be fastened in a gradually regulatable manner to the support member 22*c*′, for adjusting the distance between stocking and building. In the lugs 22*d*′ a vertical guide 18' or 19' is formed for an associated hoisting line. By means of ears 32 fastened to outer corners of the support member 22*c*′ there are formed corresponding fastening points 33 for obliquely extending lines 25,26 and vertical guides 34 for stabilising lines (hoisting lines) 27,28.

In FIG. 4 and 5 there is shown a second construction of a stocking 10', where the stocking is especially adapted for large floor heights of an order of magnitude of 4 meters between the floors. Instead of three bracing rings 11 (as shown in FIG. 1–2) between each floor height as illustrated in the adjacent building, five bracing rings 11' are employed between each floor height. One and the same distance of approximately 1 meter is shown between each pair of bracing rings 11'.

In FIG. 4 and 5, the guy-forming lines 25,26, as shown in FIG. 1 and 2, are omitted, and instead the screen-forming guide means are fastened to vertically extending stabilising a lines 27',28' in a continuous path in a vertical direction along the stocking, but moreover are fastened to the connecting means 22' and to the transition portion between the back portion 10*a*′ and the front portion 10*b*′ in a manner corresponding to that indicated in connection with FIG. 1 and 2.

In FIG. 4 and step-forming grommets 35' are shown fastened to the back portion 10*a*′ in the funnel-shaped sections just below the access opening 10*d*′.

There is also shown a substantially zig-zag shaped passage in the construction according to FIG. 4 and 5. Especially at floor heights of approximately 4 meters or more however, it is possible to arrange the slide paths in several different ways, three or more funnel-shaped stocking sections being able to be employed between each floor. Instead of employing slide paths which are turned 180 degrees relative to each other, this involves for example being able to employ slide paths which are turned 90 degrees gradually relative to each other over the whole height direction of the stocking. If desired, each slide path can run in a "helical" path or one deflected in a similar manner. Thereby persons, who use the stocking as an escape route, can effect an equivalent "turning" descending movement through the stocking, instead of a typical zig-zag shaped descending movement as explained above.

Alternatively, slide paths can be employed which run substantially parallel to each other in generally the same oblique direction, separated by for example an intermediate bag-shaped stocking section.

In FIG. 4 and 5 (and in FIG. 1 and 2) connecting means or entry boards are only shown on the side of the stocking which faces towards the building, but in special cases entry boards can be employed in addition also on the side of the stocking which faces away from the building, in order thereby to provide access between the stocking and if desired other escape devices (for example ladders, step arrangements or the like) not shown further. If three funnel-shaped stocking sections are employed between each floor height it is also possible to employ the connecting means or the entry board at the access opening to the middlemost stocking section, that is to say to employ generally the connecting means or the entry board in all stocking sections within each floor height. In these instances, one can if necessary close off with extra cloth material or net material certain of the access openings which face away from the building and only employ the connecting means or the entry board like this at specific locations in the height direction of the stocking.

In the illustrated embodiments, the slide paths are shown fastened above and below to an associated upper and lower bracing ring respectively, but in practice it will also be possible to fasten the slide paths to the stocking itself at a distance from the bracing rings, for example fastened to reinforced portions of the cloth material in the stocking and if necessary with the reinforced portions anchored to bracing ring.

In FIG. 5, a lock-fashioned passage is shown in combination with the entry board, where a covering of cloth material is employed both on two sides of the passage and at the top of the passage and in addition cloth material also at the vertical entry portion 37' to the passage. An upper roof portion 38' of cloth material and two mutually separated, but tightly impacting, doorway-forming portions 39',40' of cloth material are shown. In FIGS. 5 and 6 there is shown an alternative construction of locking means of the connecting means (entry board) and locking means of the building. The locking means of the connecting means is shown in the form of a loop portion 123 turned locally downwards, that is to say offset, from loop portion 122*a* of the connecting means. The locking means of the building is illustrated correspondingly in the form of a sleeve 124 stationarily fastened to the building with a longitudinal insertion slot 124*a* for the loop portion 123. The slot 124*a* is provided with a constricted opening and with the slot opening faced in a direction away form the stocking and its connecting means, so that the loop portion 123 can be readily hooked into place and is ensured effective engagement by being received with a relatively close fit in the associated slot in the sleeve 124.

Instead of the circular or elliptical space rings, as shown in the drawings, there can be employed for example rectangular space rings, which can have the one side edge running parallel to the adjacent house wall.

In the illustrated embodiment, the connecting means is shown in permanent rigid union with the adjacent bracing ring and projecting laterally outwards from the same. In an embodiment not illustrated further the connecting means can be pivotably mounted about a horizontal axis on the bracing ring, so that it can be rotated relative to this and for example pivoted inwardly into the bracing ring in the inactive position of the stocking. Automatic pivoting of the connecting means can be obtained outside the bracing ring on putting out the stocking from the inactive position.

Alternatively, (not shown further) the connecting means will be able to be fastened permanently in combination with the house wall and preferably be pivotable about a horizontal axis relative to a fastening on the house wall, so that in the inactive condition of the stocking the connecting means can be pivoted into place in an inactive position along the house wall.

In order to be able to adapt the connecting means according to different height deviations between the wall opening on the house wall and the access opening in the stocking the connecting means can be pivotably mounted about a horizontal axis at both its opposite ends. In FIG. 3*a* and 3*b* a connecting means is shown which can be regulated as to length according to need, but with a connecting means which is pivotably mounted about a horizontal axis at opposite ends there is preferably employed a connecting means of permanent length.

I claim:

1. An escape device comprising a collapsible tubular stocking having a plurality of longitudinally disposed sections, each said section having a vertically extending back portion and an obliquely extending front portion defining a funnel-shaped passage therebetween;

a plurality of bracing rings secured to said stocking at spaced apart intervals, each bracing ring being disposed between a respective pair of said stocking sections and defining an access opening into a funnel-shaped passage of a respective stocking section therebelow; and a plurality of rigid connecting means, each said connecting means being secured to a respective bracing ring to project from said ring for mounting in an opening of a building to provide an access path for an occupant of the building to a respective access opening for entry into said stocking.

2. An escape device as set forth in claim 1 wherein at least one rigid connecting means is fixedly secured to a respective bracing ring and includes an anchoring means at one end for releasably connecting to a locking means at an opening of a building.

3. An escape device as set forth in claim 1 wherein at least one rigid connecting means is pivotally mounted on a respective bracing means to pivot about a horizontal axis.

4. An escape device as set forth in claim 1 wherein at least one of said rigid connecting means includes a rigid support member, a loop telescopically mounted in said support member and a plate secured to and across said loop whereby said one rigid connecting means is horizontally adjustable.

5. An escape device as set forth in claim 1 which further comprises a pair of screen-forming guide means secured to and between each rigid connecting means and an adjacent stocking section to define a passage into said adjacent stocking section.

6. An escape device as set forth in claim 1 which further comprises a lock-fashioned passage of cloth material disposed over each rigid connecting means and located adjacent a respective stocking section.

7. An escape device as set forth in claim 1 wherein said stocking sections are rotated 180° relative to each other about a common vertical axis to define a zig-zag path therethrough.

8. In combination, a building having a series of vertically spaced wall openings;

a vertically disposed collapsible tubular stocking having a plurality of longitudinally disposed sections located adjacent said building, each said stocking section having a vertically extending back portion and an obliquely extending front portion defining a funnel-shaped passage therebetween;

a plurality of bracing rings secured to said stocking at spaced apart intervals, each ring being disposed between a respective pair of said stocking sections and defining an access opening into a funnel-shaped passage of a respective stocking section therebelow; and a plurality of rigid connecting means secured to and between said building and at least some of said bracing rings to space said stocking from said building, each said rigid connecting means being disposed in a respective opening of said building to provide an access path for an occupant to a respective access opening for entry into said stocking.

9. The combination as set forth in claim 8 which further comprises a locking means at each said building opening and an anchoring means on each said rigid connecting means for releasable securement to a respective locking means.

10. The combination as set forth in claim 8 which further comprises a pair of screen-forming guide means secured to and between each rigid connecting means and an adjacent stocking section to define a passage into said adjacent stocking section.

11. The combination as set forth in clam 8 wherein at least one of said rigid connecting means includes a rigid support member, a loop telescopically mounted in said support member and a plate secured to and across said loop whereby said one rigid connecting means is horizontally adjustable between said building and said stocking.

* * * * *